US010245706B2

(12) United States Patent
Kolthoff

(10) Patent No.: US 10,245,706 B2
(45) Date of Patent: Apr. 2, 2019

(54) TOOL FOR FINE MACHINING OF SURFACES

(71) Applicant: Kolthoff Gabrovo EOOD, Gabrovo (BG)

(72) Inventor: Dieter Kolthoff, Flüelen (CH)

(73) Assignee: Kolthoff Gabrovo EOOD, Gabrovo (BG)

( * ) Notice: Subject to any disclaimer, the term of this patent is extended or adjusted under 35 U.S.C. 154(b) by 131 days.

(21) Appl. No.: 15/373,931

(22) Filed: Dec. 9, 2016

(65) Prior Publication Data

US 2017/0165811 A1 Jun. 15, 2017

(30) Foreign Application Priority Data

Dec. 9, 2015 (DE) ..... 20 2015 106 711 U

(51) Int. Cl.
*B24D 13/16* (2006.01)
*B24D 13/14* (2006.01)
*B24D 13/20* (2006.01)

(52) U.S. Cl.
CPC ..... *B24D 13/14* (2013.01); *B24D 13/142* (2013.01); *B24D 13/145* (2013.01); *B24D 13/20* (2013.01)

(58) Field of Classification Search
CPC ..... B24D 15/081; B24D 13/10; B24D 13/04; B24D 13/16; B24D 15/08; B24B 33/08; B24B 15/00
USPC ..... 451/463, 496, 464–469
See application file for complete search history.

(56) References Cited

U.S. PATENT DOCUMENTS

| | | | | |
|---|---|---|---|---|
| 1,670,302 | A | 5/1928 | Finnell | |
| 3,410,032 | A | 11/1968 | Meinerding | |
| 3,890,746 | A | 6/1975 | Saegusa et al. | |
| 4,461,127 | A * | 7/1984 | Hanger | B24D 13/16 15/180 |
| 4,493,170 | A * | 1/1985 | Hanger | B24D 13/16 451/463 |
| 5,201,149 | A | 4/1993 | Eisenblätter | |
| 2009/0104859 | A1 | 4/2009 | Weiland | |
| 2010/0330887 | A1 | 12/2010 | Hawkins | |
| 2011/0097978 | A1 | 4/2011 | Hofmann et al. | |
| 2014/0017982 | A1 | 1/2014 | Himmer | |

(Continued)

FOREIGN PATENT DOCUMENTS

| | | |
|---|---|---|
| DE | 20 2010 001 388 | 6/2010 |
| EP | 1 262 283 | 12/2002 |
| JP | S56157957 | 12/1981 |

*Primary Examiner* — Robert Rose
(74) *Attorney, Agent, or Firm* — Gudrun E. Huckett

(57) ABSTRACT

A tool for fine machining surfaces has a working medium carrier with a top face and a bottom face, wherein the bottom face is an attachment side. A set of individual exchangeable strip-shaped lamella holders are provided that each have one or more lamellas in individual or bundled arrangement. The lamellas each are oriented away from the attachment side of the working medium carrier and form in a downward direction remote from the attachment side a common working plane. The lamella holders on a side facing the attachment side are provided with first hooking members and the attachment side of working medium carrier is provided with second hooking members complementary to the first hooking members. The first and second hooking members are joined to each other in a direction perpendicular to the attachment side.

11 Claims, 7 Drawing Sheets

(56) References Cited

U.S. PATENT DOCUMENTS

| | | | |
|---|---|---|---|
| 2015/0209938 | A1 | 7/2015 | Kolthoff |
| 2015/0306738 | A1 | 10/2015 | Palushaj |

* cited by examiner

TOOL FOR FINE MACHINING OF SURFACES

BACKGROUND OF THE INVENTION

The invention relates to a tool for fine machining surfaces, such as cleaning, grinding or polishing. The tool comprises a working medium carrier provided at the bottom face with an attachment side. A set of individually exchangeable strip-shaped lamella holders holding bundled or individual lamellas are attached to the attachment side. The lamellas are oriented away from the working medium carrier and form in downward direction a common working plane.

Such a tool is disclosed, for example, in US 2015/0209938 A1. Tools of this kind, in which working media for fine machining surfaces are attached to strip-shaped lamellas and are secured by strip-shaped lamella holders, provide in comparison to simple abrasive paper sheets great quantities of working medium and also a greater volume for material that is removed by surface fine machining; therefore, they provide longer service life of the tool due to extended wear cycles.

Still, even for tools with lamellas, wear-based exchangeability of the lamellas is to be provided when a complete exchange of the tool is not possible as an alternative. In comparison to a complete tool exchange, the exchangeability of individual lamellas has however the advantage that only individual damaged or worn lamellas can be exchanged without great expenditure. Moreover, the exchange of individual lamellas provides the possibility of attaching to the tool mixed working media that are specific to a given application. Finally, individual exchangeable lamellas or lamella bundles, held by a strip holder, provide the manufacturer with design possibilities already in connection with tool configuration by means of a uniform working medium carrier for various tools with application-specific individual sets of lamellas. It is understood that usually, as is common practice, the lamellas are bundled, i.e., several are combined, and together held by a lamella holder, even though in principle also an individual lamella strip can be connected to a lamella holder.

The tools considered here are in practice mostly rotary tools in which the tool holder is provided with a standardized drive connector and, by means of the drive connector, is to be connected to a rotary drive, for example, a hand-held power drill. Such a tool is typically shaped like a circular disk with a centrally arranged drive connector. In general, a tool can also be configured to perform oscillating movements of the lamellas by means of an appropriate drive connector for a corresponding drive and, in this context, the working medium carrier can also have angular basic shapes. Finally, a tool of the kind considered here can also be a manual tool, without drive connector but provided with a grip or handle.

In US 2015/0209938 A1, the individually exchangeable lamella holders together with the lamellas held by the lamella holders are pushed lengthwise into open-end grooves in the working medium holder. In this context, the lamellas pass through narrow slots at the attachment side and project from the grooves. The grooves are open at the top and covered by a cover that closes off the grooves together with the lamellas contained therein. This design of the tool enables variable configurations of the lamellas already during manufacture and when replacing the lamellas and is also simple and inexpensive with respect to manufacture of the tool support. However, the required secure and fixed attachment of the corresponding cover for securing the lamellas requires diligence. In particular, the design of the continuous open grooves at top and bottom causes a weakening of the working medium carrier that limits the robustness of the tool for surface machining and increases the necessary diligence when mounting the tool upon exchange of the lamellas.

It is the object of the invention to design a tool of the aforementioned kind in a more robust construction and with a simpler design in regard to furnishing the tool wilt lamellas during manufacture but also during use of the tool, in particular for exchange of the lamellas, while maintaining a simple configuration that is advantageous for large volume production.

SUMMARY OF THE INVENTION

In accordance with the invention, this is achieved in that the lamella holders, on their face facing the attachment side of the working medium carrier, and the attachment side of the working medium carrier are provided with first and second hooking members (hooking elements or hooking receptacles) which are designed complementary to each other and which are to be joined in a direction perpendicular to the attachment side.

The solution according to the invention provides a hooked connection of the lamella holder with the working medium carrier at its attachment side; this is done in particular by means of hooking elements and hooking receptacles which are of a complementary design relative to each other and which are joined or connected to each other perpendicular to the attachment side. In contrast to the prior art, the lamella holders are not pushed into a groove in a direction parallel to the attachment side but are advanced from the attachment side toward the working medium carrier and hooked. The hooking action can be realized in the form of a movement which is oriented transversely to the advancing movement by hook-shaped elements. In this context, the hook-shaped elements can be provided on the lamella holders in order to engage hook receptacles provided on the working medium carrier. The hooking elements can be attached in principle also on the working medium carrier on its attachment side and anchored in hooking receptacles provided on the lamella holders. In this context, the hooked connections can be realized in the form of locked connections so that the hooking elements upon insertion into hooking receptacles are deflected yieldingly, in particular in a springy (elastic) fashion, in order to then engage behind a matching undercut face and snap into place thereat.

For forming such locking or non-locking hooked connections between the working medium carrier and the lamella holders, long slots in the working medium carrier for receiving the lamellas are not required. Instead, the working medium carrier, even when it is to be provided with openings as hooking receptacles, can be designed to be primarily closed and thus have a shape-stable configuration. This contributes to the inherent stiffness of the tool as a whole and provides possibilities for thin-walled and thus material-saving configurations of the tool support.

A cover to be placed onto the tool support, that is to be attached only by means of snap-on locked connections and thus requires no separate fastening elements and no tools for mounting of such fastening elements, can thus be provided with a smooth or flat surface as a protection from injuries by the rotating or oscillating tool.

In particular for non-locking hooked connections between the working medium carrier and the lamella holders, the cover can also be provided with stop edges, blocking cams or the like which engage hooked connections of the lamella holders, that extend through the working medium carrier in the hooked position, and secure them against accidental unhooking. However, a cover for producing a fixed hooked connection between the lamella holders and the working medium carrier is not necessarily required for hooked connections of the locking kind.

BRIEF DESCRIPTION OF THE DRAWING

Three embodiments of the invention are illustrated in the drawing and will be explained in the following in more detail.

DESCRIPTION OF THE PREFERRED EMBODIMENTS

Figure 1:
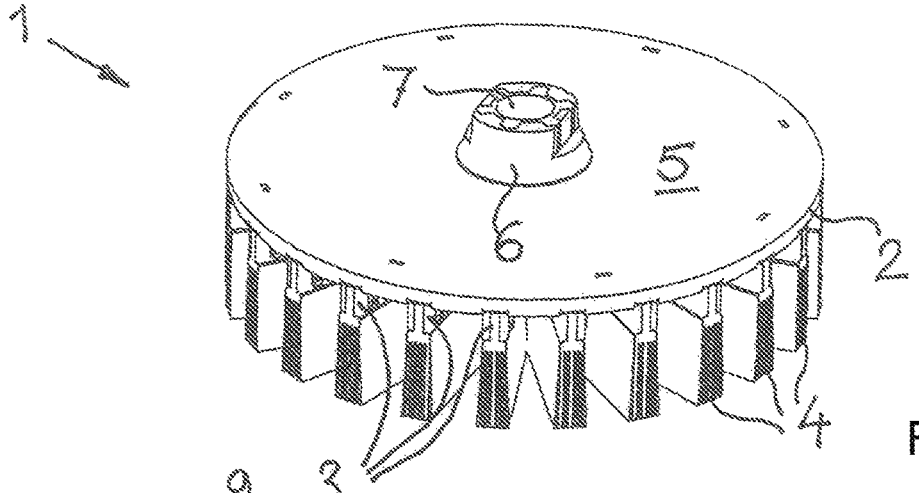
FIG. 1 shows a tool according to the invention in a first embodiment viewed in a perspective view from above.

FIG. 1 shows a tool 1 with a working medium carrier 2, lamellas 4 in bundled form arranged at the bottom face of the working medium carrier 2 and secured thereat by lamella holders 3, and a cover 5 locked into place at the top face. The tool 1 is shown in a typical working position in which the lamellas 4 are pointing downwardly away from the working medium carrier 2 and form with their end faces a common working plane. In this respect, in the above brief description of the drawings, the terms above and below (top and bottom) refer to this working position as it is employed when machining a primarily horizontally positioned workpiece surface for fine machining the surface. This does not preclude that the tool 1 is moved and utilized freely in any other position and that the tool 1, in case of vertical workpiece surfaces or in case of workpiece surfaces arranged over head, can also have a different orientation for machining.

The tool 1 in the present case is designed for a rotary working movement and is of rotational symmetry with a central drive connector 6 on the top face; the drive connector 6 comprises a stronger metallic connecting element 7 for connecting to a standard connector on a rotary drive machine, for example, a power drill, and the connecting element 7 is embedded (molded) in the working medium carrier 2 that is designed as an injection-molded plastic part. The drive connector 6 passes from below through the cover 5 that is designed substantially as an annular disk.

Figure 3:
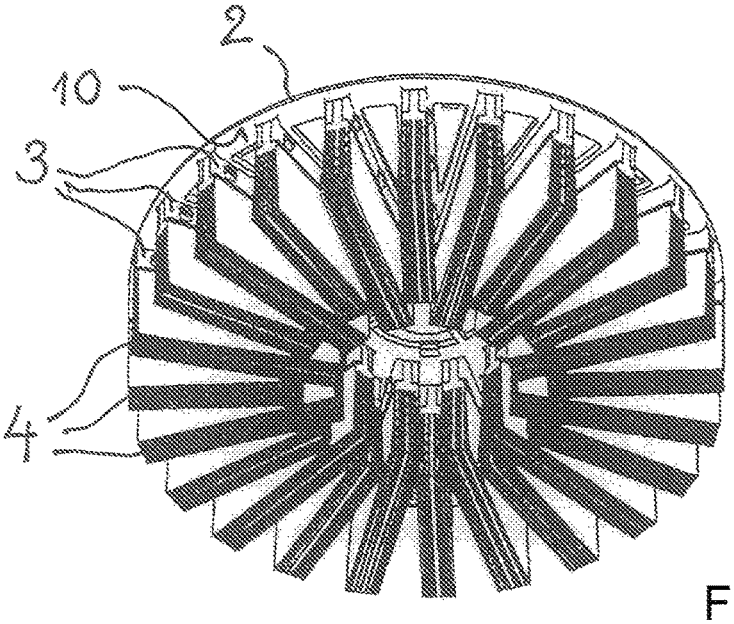
FIG. 3 shows the tool according to FIG. 1 and FIG. 2 in a perspective view from below.

The lamellas 4 are of a strip-shaped configuration and several are combined to a bundled arrangement within each lamella holder 3. In the present case, the lamellas 4 are pointing away from the working medium carrier 2 in downward direction, i.e., toward an imaginary common workpiece surface or a similar plane to be machined parallel to the working medium carrier 2. As is shown in particular in FIG. 3, the lamellas 4 with their corresponding lamella holders 3 are oriented radially within a circular surface and in the inner area of the circular surface, where they converge as a result of the radial orientation, are designed to be shorter or longer due to space restrictions. In this context, an interior space below the drive connector 6 remains free where, in case of rotary surface machining, less of a machining effect is obtained anyway due to the reduced tangential speed. Tools of this kind are primarily placed anyway at a slant onto a workpiece so that the outer areas of the lamellas are effective.

Figure 2:
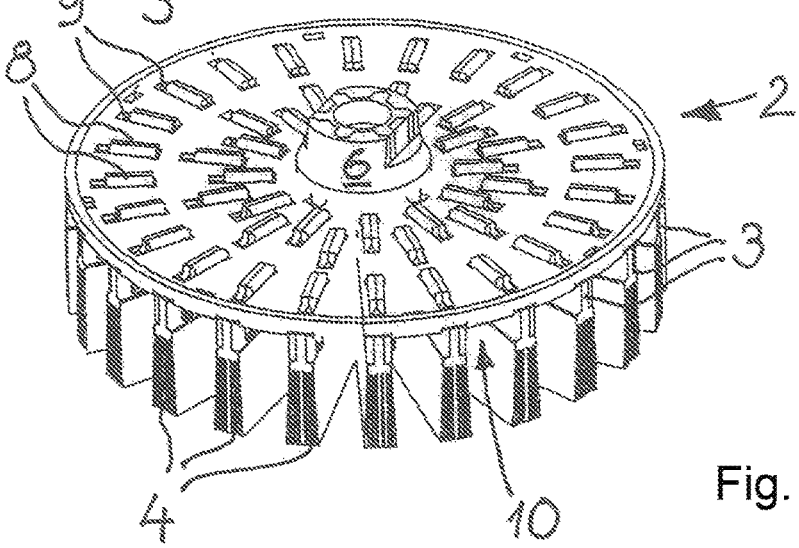
FIG. 2 shows the tool according to FIG. 1 in the same viewing direction without cover at the top.

FIG. 2 shows, with the cover 5 removed, hooked connections between the lamella holders 3 and the working medium carrier 2 comprising first and second hooking members in the form of e.g. hooking elements 8 provided on the lamella holder 3 and in the form of e.g. hooking receptacles 9 provided in the working medium carrier 2. The respective lamella holder 3 together with lamellas 4 is passed from the downwardly facing attachment side 10 of the working medium carrier 2 through the respective hooking receptacles 9 and, after having passed through the hooking receptacle 9 of the working medium carrier 2, is hooked by a movement in a radial inward direction. In this context, two hooking elements 8 and two corresponding hooking receptacles 9 for each lamella holder 3 are provided so that the radial orientation of the lamella holders 3 is fixedly predetermined. A clearance-free hooked connection between the lamella holders 3 and the working medium carrier 2 is moreover advantageously provided in order to transfer, as the tool 1 rotates during working, the forces and moments, applied by the drive through the working medium carrier 2 with integrated drive connector 6, into the lamella holders 3 and the lamellas 4. Such a clearance-free connection, optionally strengthened with pretension, between the lamella holders 3 and the working medium carrier 2 can be produced precisely between plastic parts by injection molding, in particular when, as in the present case, the working medium carrier 2 and the lamella holder 3 are made of plastic material.

For the fixedly anchored seat of the lamella holders, a form-fit configuration of the contact surfaces between the lamella holders 3 and the (bottom) attachment side 10 of the working medium carrier 2 is also advantageous for which purpose the lamella holders 3 are provided with a topside shape which upon hooking engage radially extending grooves, shaped complementary to the topside shape of the lamella holders 3, provided at the attachment side 10 of the working medium carrier 2.

Figure 4:
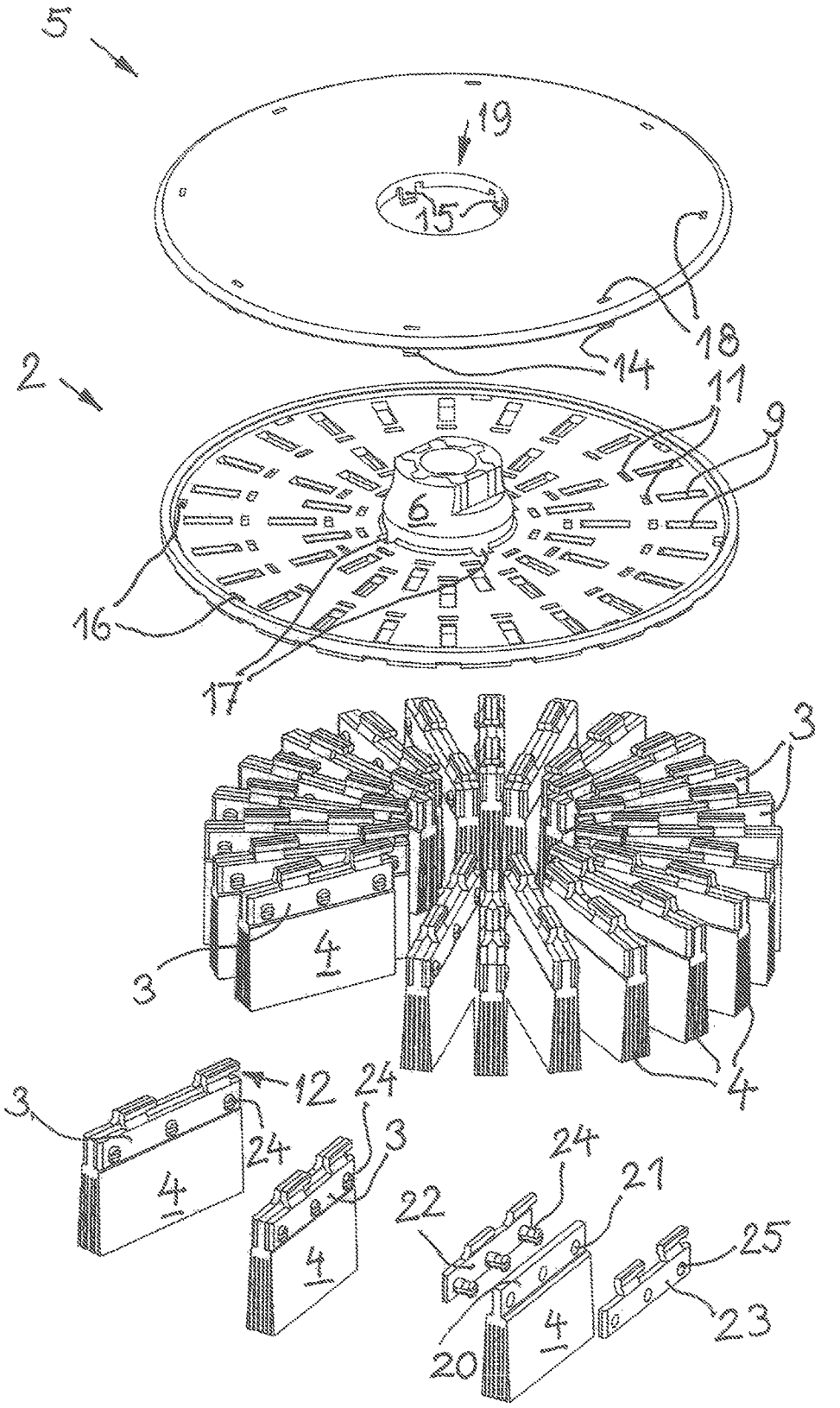
FIG. 4 shows an exploded view of the tool according to FIGS. 1 through 3 in a perspective view from above to show the individual parts.
Figure 5:
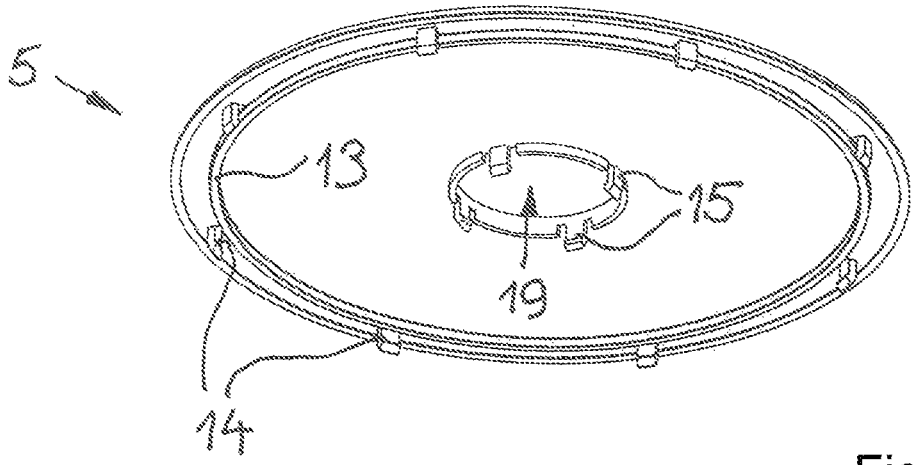
FIG. 5 shows the cover as an individual part of the tool according to FIGS. 1 through 4 in a perspective view from below.

As can be seen in the exploded illustration of FIG. 4, at the top face of the working medium carrier 2, the respective hooking receptacles 9 have correlated therewith locking recesses 11 that are radially inwardly positioned relative to the hooking receptacles 9. They accommodate in the hooked position according to FIG. 2 locking noses 12 of the hooking elements 8 provided at the lamella holders 3. The locking noses 12 are arranged at the leading end of the hooking elements 8 and project toward the top face of the working medium carrier 2; upon insertion of the lamella holders 3 and upon radial inwardly oriented insertion for realizing the hooked engagement, these locking noses 12 will lock in the locking recesses 11. This is a securing action of the hooked connection of the lamella holders 3 on the working medium carrier 2 against becoming unhooked under the action of the working forces and centrifugal forces acting during the rotational working movement. Insofar, there is in principle the possibility of operating the tool 1 without the cover 5.

The cover 5 however not only provides a smooth or flat surface which is important with respect to protection against injury or operational disturbances by the rotating tool 1, but also provides a securing action of the hooked connections between lamella holders 3 and working medium carrier 2 in that the cover 5 with its underside engages behind the hooked connections and secures them in this way. In the present case, the cover 5 is provided with a downwardly oriented annular collar 13 which engages from behind the radially outwardly positioned hooking elements 8 of the lamella holders 3, which are located uniformly on a common radius when hooked, and thereby blocks them from becoming unhooked.

The cover 5 is also designed as an injection-molded plastic part and comprises at the underside facing the working medium carrier 2 an annular arrangement of locking hooks 14, in the present case eight of them, as well as an inner annular arrangement of locking hooks 15, in the present case four, which are to be locked in openings 16 or 17, provided in the working medium carrier 2 and having a matching configuration, in order to provide a simple and quick connection without separate connecting elements. In order to be able to unlock the locking hooks 14 from above with a simple tool, such as a screwdriver or pin, the surface of the cover 5 has directly adjacent to the locking hooks 14 insertion openings 18 while the locking hooks 15 are directly accessible for unlocking through the central opening 19 of the cover 5.

In the individual part illustration according to FIG. 4, at the bottom of the illustration, several lamella holders 3 with corresponding bundles of lamellas 4 are illustrated wherein the lamella bundles as illustrated are joined at the top by a cast strip 20 with holes 21.

The lamella holders 3 are formed each of two parallel holding rails 22, 23 that both have upwardly projecting parallel hooking elements which are to be hooked in the hooking receptacles 9 of the working medium carrier 2 as twin hooks and, due to the doubled configuration, provide for a more uniform introduction of working forces into the lamellas. The holding rails 22, 23 are contacting opposite sides of the top edges of the lamellas 4 when they are held together against each other by a locked connection of locking elements in the form of locking pins 24 and locking holes 25. The locking pins 24 penetrate the holes 21 in the lamellas 4. Such a configuration of the holding rails 22, 23 for a matched assembly of the lamella holders is advantageously obtainable by injection molding of plastic material in large volume production. In this context, the locking pins 24 are of an elastically yielding slotted configuration and the ends are designed as a conically tapering locking head which forms behind the locking head a fixedly locking undercut face that hooks at the holding rail 23.

Figure 6:
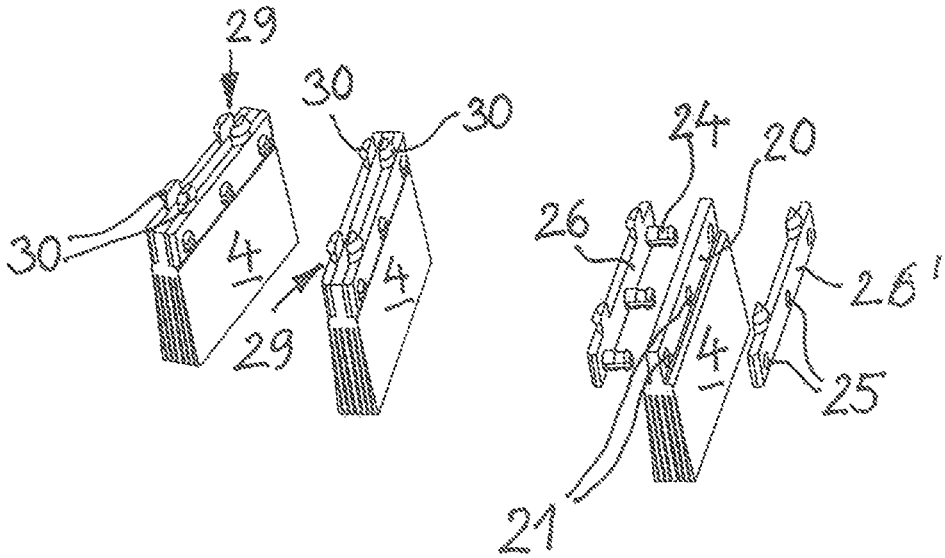
FIG. 6 shows the lamellas and the lamella holders of a second embodiment of the tool according to the invention.

In comparison to the embodiment illustrated in the bottom section of FIG. 4, FIG. 6 shows an alternative embodiment of lamella holders and lamellas of a tool according to the invention. In the embodiment of FIG. 6, lamellas 4 are joined to a bundle that has holes 21 at the upper end through which the locking pins 24 of a holding rail 26 can be pushed through in order to pass through locking holes 25 in the parallel holding rail 26' on the other side of the lamellas 4 and to lock at the holding rail 26'.

Figure 7:
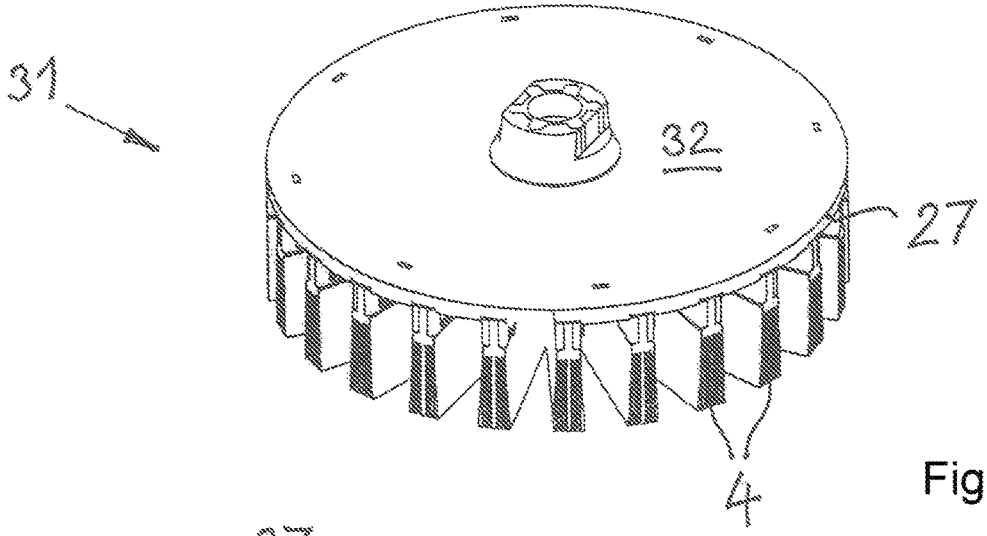
FIG. 7 is a view of the tool according to the second embodiment in a perspective view from above.
Figure 8:
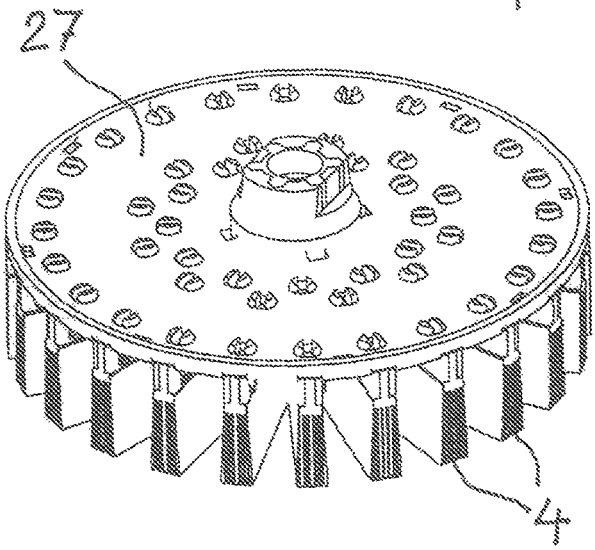
FIG. 8 is a view of the tool according to FIG. 7 in the same viewing direction but without cover.
Figure 9:
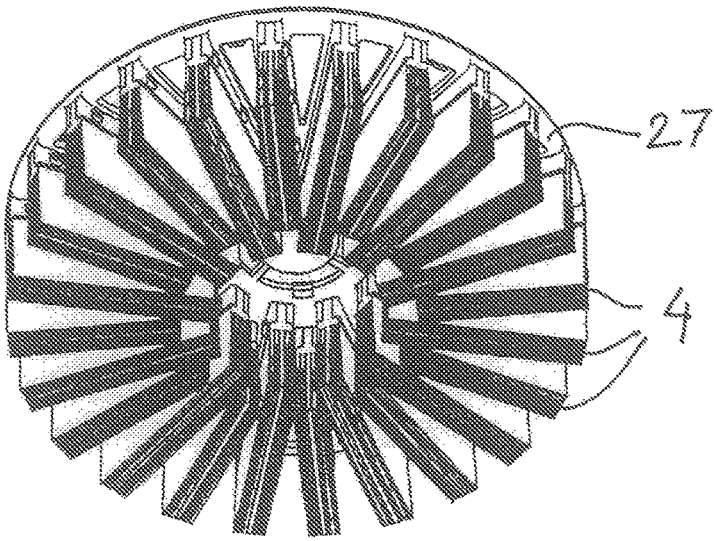
FIG. 9 shows a view of the tool according to FIGS. 7 and 8 in a perspective view from below.
Figure 10:
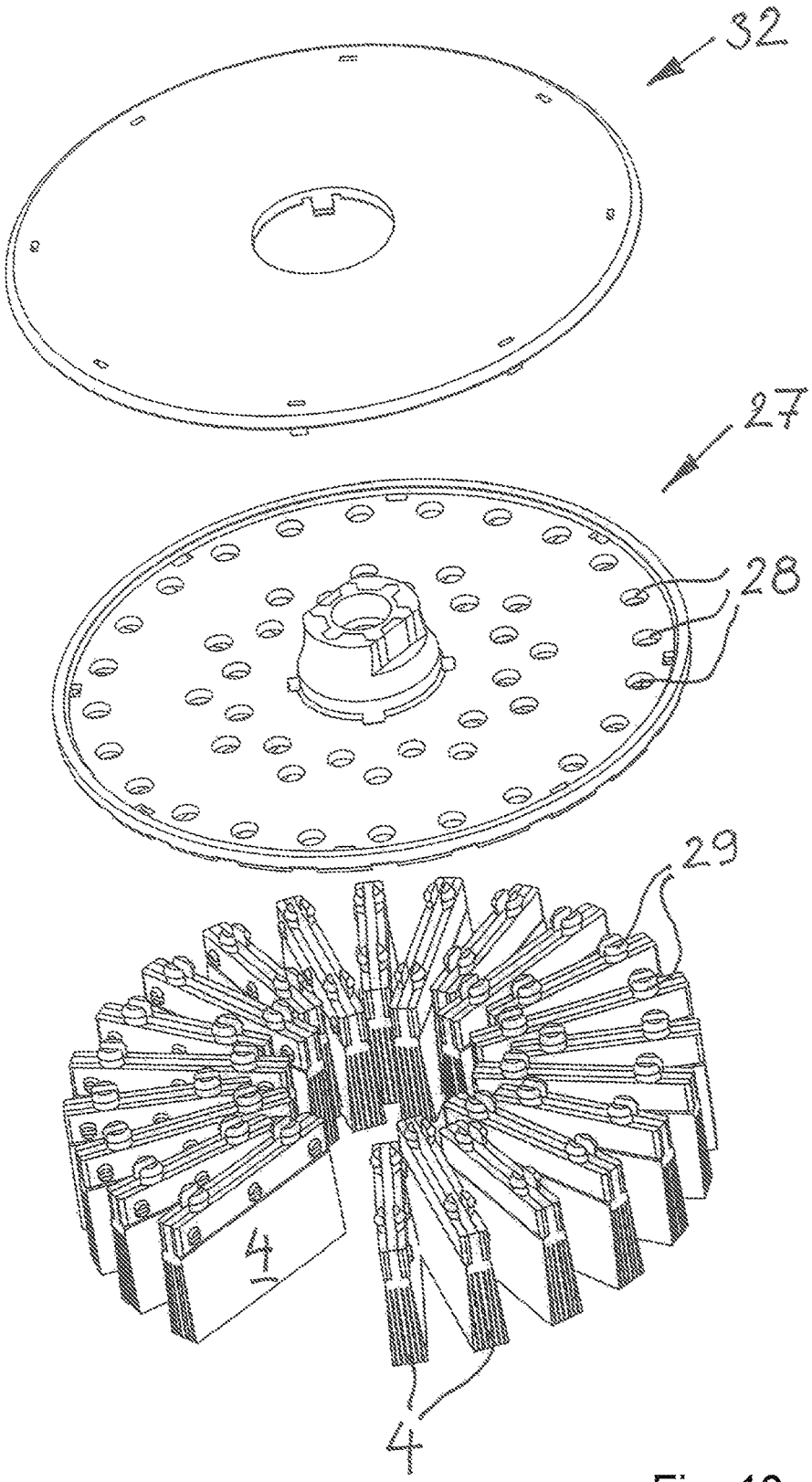
FIG. 10 is an exploded view of the tool according to FIGS. 7, 8, and 9 in a perspective view from above to show the individual parts.

The holding rails 26, 26' are however different from the holding rails 22, 23 of the afore described embodiment because they form together common locking pins for producing a hooked connection with a corresponding working medium support 27 (FIG. 7); these locking pins are designed to lock in approximately circular holes 28 (compare FIG. 10) of the working medium carrier 27. The locking pins that are referred to as a whole by reference number 29 are comprised of two locking pin segments 30; a first locking pin segment 30 is formed on holding rail 26 and the other on the second holding rail 26'. The two locking pin segments 30 together define an approximately circular contour. However, an intermediate space remains between the segments 30 and the segments 30 can deflect relative to each other into this space upon hooking or locking. In upward direction, the configuration of the locking pin 30 comprises a head which at the end tapers conically for easier insertion and has, behind the head, recessed undercut faces which after insertion through the working medium carrier 27 lock as undercut faces on the top surface of the working medium carrier 27. The working medium carrier 27 with lockingly hooked lamella holders can be seen in FIG. 8. In this type of hooked connection, the lamella holders are secured against centrifugal forces and radial loading already by the hooked connection so that a tool 31 according to FIG. 7 can receive a cover 32 for improved visual appearance and as a contact protection; in comparison to the cover 5 of the afore described embodiment, such a cover 32 has no functional securing projections such as the annular collar 13 of cover 5. The cover 32 however can be embodied as a monolithic injection-molded plastic part just like the cover 5 which is to be hooked with matching hooks in openings of the working medium carrier 27.

Figure 11:
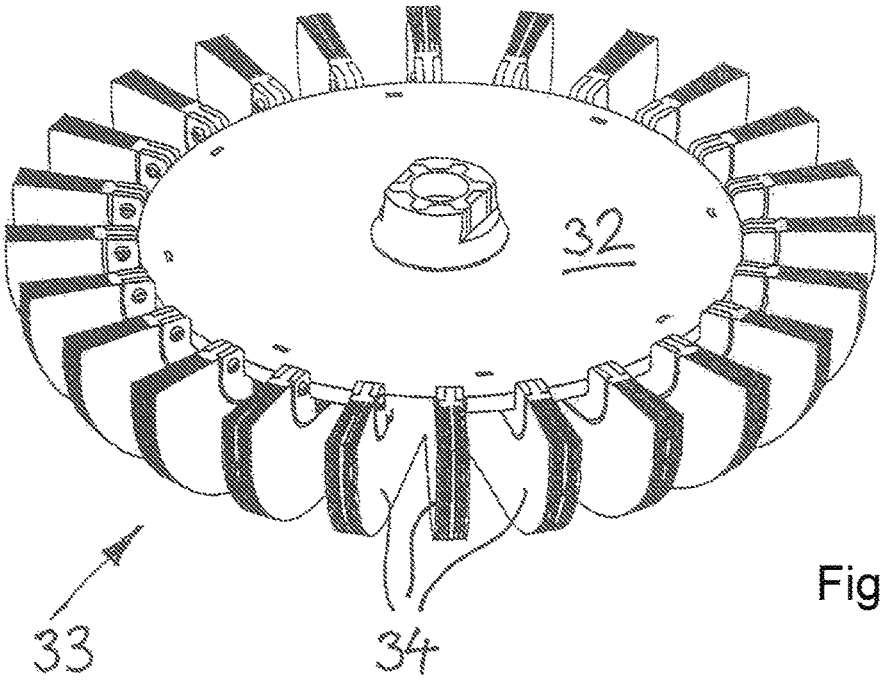
FIG. 11 is a view of a third embodiment of the tool according to the invention in a perspective view from above.
Figure 12:
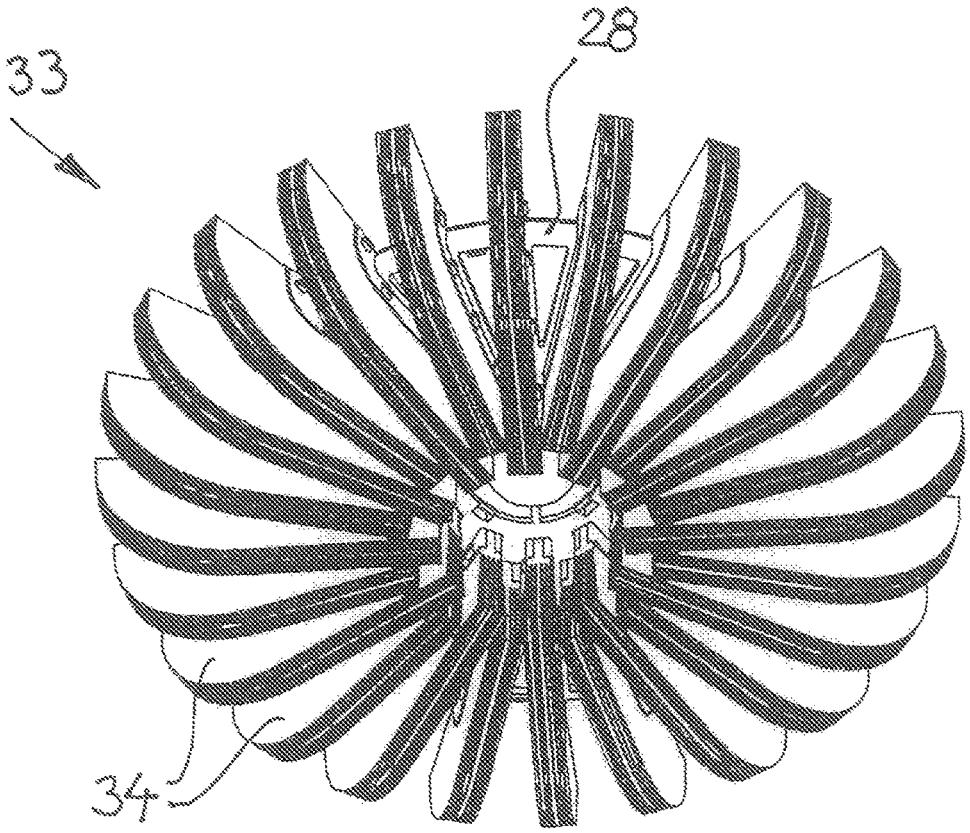
FIG. 12 shows the tool of FIG. 11 in a perspective view from below.
Figure 13:
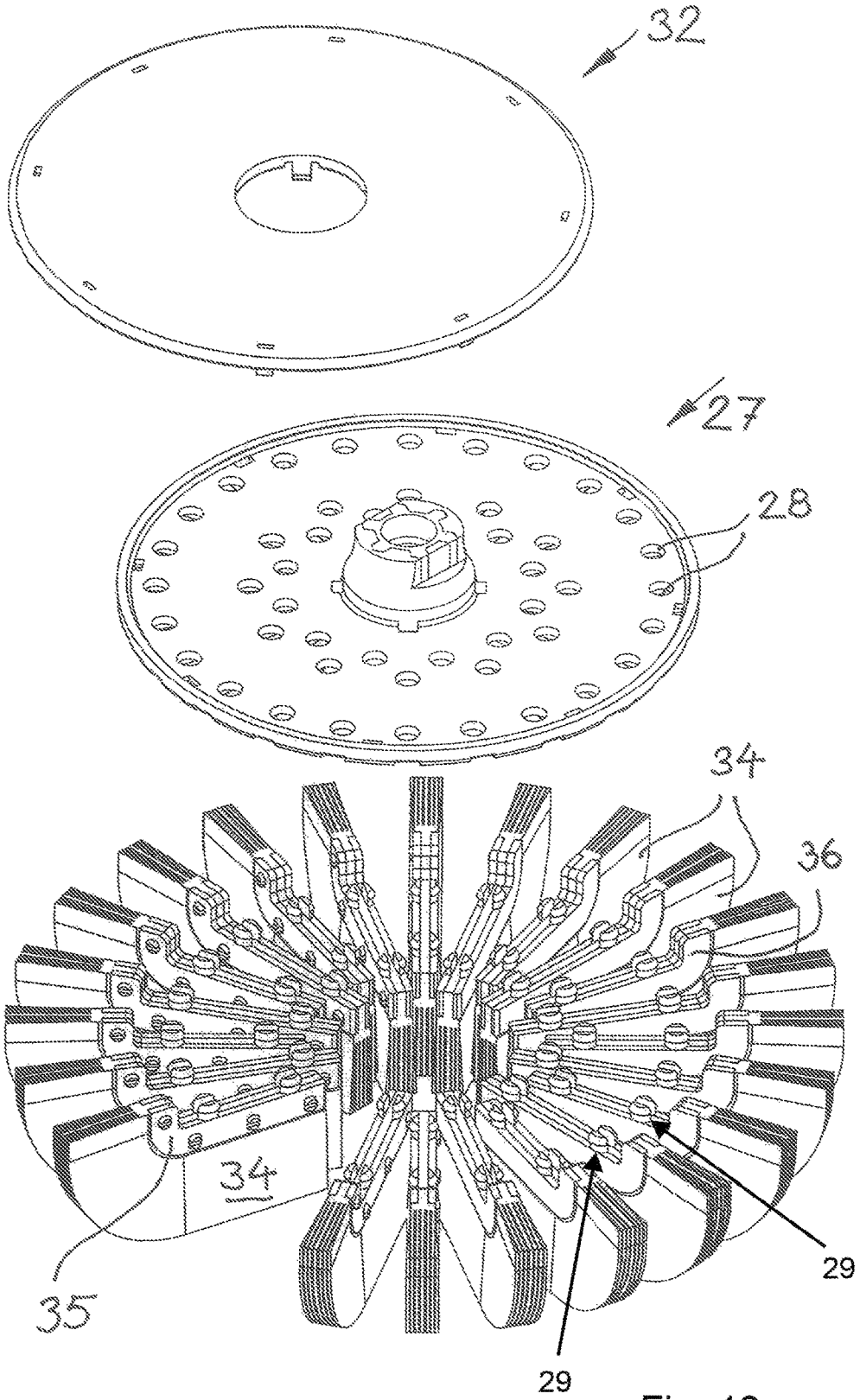
FIG. 13 is an exploded view of the tool according to FIGS. 11 and 12 in a perspective view from above to show the individual parts.

In FIGS. 11, 12, and 13, a variant of the tool 33 is illustrated which is modified with respect to the shape of the lamellas: here, the lamellas are not rectangular strips extending radially like rays below the attachment side but project radially outwardly past the working medium carrier 27 and extend up to the level of the working medium carrier 27 with their rounded working edges. The working medium carrier 27 can be configured in the same way as the afore described working medium carrier 27 of the second embodiment. Also, a cover 32 that is provided expediently on the working medium carrier 27 of the third embodiment can be configured as disclosed in the second embodiment. The lamellas 34, as shown in particular in FIG. 13, are of an arc-shaped configuration on the exterior side in comparison to an inner straight strip shape and are engaged between angled holding rails 35, 36 which comprise, relative to the holding rails 26, 26' of the afore described embodiment, additional locked connections relative to each other at the angled end. For locking action with the working medium carrier 27, locking pins 29 are formed also on the holding rails 35, 36 and, together in paired arrangement as pin-shaped hooking elements, are to be introduced into circular openings 28 of the working medium carrier 27 and locked thereat, respectively.

The afore described embodiments of the tool provide a simple and quickly assembled configuration, in particular in an embodiment as injection-molded parts of plastic material; such plastic material is available in a plurality of injection-moldable and also load-resistant and temperature-resistant form. Equipping such a tool at the manufacturer with possibly variable lamellas is possible in a variable and simple way due to the fixation of the lamella holders by hooked connections. In particular, also the use of the corresponding tool that requires wear-caused exchange on a regular basis is simple and the exchange can be easily performed without any critical steps. At the same time, the configuration of the tool with a stable continuous plate shape of the working medium carrier and with lamellas that as a whole are arranged below the working medium carrier can be produced in a material-saving and accordingly inexpensive way in large volume production.

The specification incorporates by reference the entire disclosure of German priority document 20 2015 106 711.9 having a filing date of Dec. 9, 2015.

While specific embodiments of the invention have been shown and described in detail to illustrate the inventive principles, it will be understood that the invention may be embodied otherwise without departing from such principles.

What is claimed is:

1. A tool for fine machining of surfaces, the tool comprising:

a working medium carrier comprising a top face and a bottom face, wherein the bottom face is an attachment side;

a set of individual exchangeable strip-shaped lamella holders, each comprising one or more lamellas in individual or bundled arrangement, wherein the lamellas each are oriented away from the attachment side of the working medium carrier and form in a downward direction remote from the attachment side a common working plane;

wherein the lamella holders on a side facing the attachment side are provided with hooking elements and wherein the attachment side of the working medium carrier is provided with hooking receptacles that are complementary to the hooking elements;

wherein the hooking elements are configured to be directly inserted into the hooking receptacles in a direction perpendicular to a downward face of the attachment side;

wherein the hooking elements comprise first undercut faces and the hooking receptacles comprise second undercut faces complementary to the first undercut faces, wherein the lamella holders, after directly inserting the hooking elements into the hooking receptacles in the perpendicular direction, are moved parallel to the attachment side so that the first and second undercut faces engage each other and hook the hooking elements and the hooking receptacles relative to each other, wherein the lamella holders are locked at the working medium carrier solely by the hooking elements and the hooking receptacles.

2. The tool according to claim 1, wherein the hooking elements are embodied as projections and the hooking receptacles are embodied as downwardly facing holes in the attachment side of the working medium carrier.

3. A tool for fine machining of surfaces, the tool comprising:

a working medium carrier comprising a top face and a bottom face, wherein the bottom face is an attachment side;

a set of individual exchangeable strip-shaped lamella holders, each comprising one or more lamellas in individual or bundled arrangement, wherein the lamellas each are oriented away from the attachment side of the working medium carrier and form in a downward direction remote from the attachment side a common working plane;

wherein the lamella holders on a side facing the attachment side are provided with hooking elements and wherein the attachment side of the working medium carrier is provided with hooking receptacles that are complementary to the hooking elements;

wherein the hooking elements are configured to be directly inserted into the hooking receptacles in a direction perpendicular to a downward face of the attachment side;

wherein the hooking elements are configured to elastically yield to move into a mutual locked connection at the hooking receptacles, or the hooking receptacles are configured to elastically yield to move into a mutual locked connection at the hooking elements, wherein the lamella holders are locked at the working medium carrier solely by said mutual locked connection.

4. A tool for fine machining of surfaces, the tool comprising:

a working medium carrier comprising a top face and a bottom face, wherein the bottom face is an attachment side;

a set of individual exchangeable strip-shaped lamella holders, each comprising one or more lamellas in individual or bundled arrangement, wherein the lamellas each are oriented away from the attachment side of the working medium carrier and form in a downward direction remote from the attachment side a common working plane;

wherein the lamella holders on a side facing the attachment side are provided with first hooking members and wherein the attachment side of the working medium carrier is provided with second hooking members complementary to the first hooking members;

wherein the first and second hooking members are configured to be joined to each other in a direction perpendicular to the attachment side;

wherein the first hooking members or the second hooking members are configured to yield for moving into a mutual locked connection;

wherein the first hooking members are yielding projections provided with undercut faces and the second hooking members are openings provided in the attachment side of the working medium carrier, wherein the yielding projections are configured to be inserted with elastic deformation into the openings and the undercut faces of the projections lock at the openings after having passed through the openings.

5. The tool according to claim 4, wherein the projections have a divided cross-section and comprise at least two spaced-apart segments.

6. The tool according to claim 5, wherein the lamella holders each are comprised of a first strip and a second strip and the one or more lamellas are secured between the first and second strips, wherein the first one of the at least two spaced-apart segments is formed on the first strip and the second one of the at least two spaced-apart segments is formed on the second strip.

7. The tool according to claim 6, wherein the first and second strips are connected to each other by locking elements.

8. The tool according to claim 1, wherein the working medium carrier comprises a plate and the plate is provided with openings forming the hooking receptacles.

9. The tool according to claim 8, further comprising a cover that closes off the plate at a top face thereof, wherein the working medium carrier comprises locking receptacles that lock the cover on the working medium carrier.

10. The tool according to claim 1, wherein the working medium carrier comprises a drive connector configured to attach the tool to a m otoric drive.

11. The tool according to claim 1, wherein the lamella holders each have a topside contacting the attachment side of the working medium carrier when the hooking elements and the hooking receptacles are in a hooked engagement with each other.

* * * * *